US007914185B2

(12) United States Patent
Moore

(10) Patent No.: US 7,914,185 B2
(45) Date of Patent: Mar. 29, 2011

(54) CHRISTMAS LIGHT CLIPS WITH MAGNETS

(76) Inventor: Brenda A. Moore, Leawood, KS (US)

( * ) Notice: Subject to any disclaimer, the term of this patent is extended or adjusted under 35 U.S.C. 154(b) by 283 days.

(21) Appl. No.: 12/314,753

(22) Filed: Dec. 16, 2008

(65) Prior Publication Data

US 2009/0185370 A1 Jul. 23, 2009

Related U.S. Application Data

(60) Provisional application No. 61/006,522, filed on Jan. 17, 2008.

(51) Int. Cl.
*F21V 21/096* (2006.01)

(52) U.S. Cl. ..... 362/398; 362/382; 362/145

(58) Field of Classification Search ..... 362/398, 362/654, 382, 145, 151
See application file for complete search history.

(56) References Cited

U.S. PATENT DOCUMENTS

| | | | | |
|---|---|---|---|---|
| 4,470,106 | A * | 9/1984 | Norton | 362/398 |
| 5,016,145 | A | 5/1991 | Singleton | |
| 5,067,061 | A | 11/1991 | Prickett | |
| 5,249,108 | A * | 9/1993 | Gary | 362/388 |
| 5,544,031 | A * | 8/1996 | Blanton | 362/396 |
| 5,609,415 | A * | 3/1997 | Protz, Jr. | 362/396 |
| 5,803,577 | A | 9/1998 | Stratton | |
| 6,520,661 | B1 * | 2/2003 | Hill | 362/249.14 |
| 2005/0024877 | A1 * | 2/2005 | Frederick | 362/277 |
| 2005/0047124 | A1 * | 3/2005 | Hsien | 362/188 |
| 2006/0279958 | A1 * | 12/2006 | Cline et al. | 362/398 |
| 2007/0223221 | A1 * | 9/2007 | George | 362/249 |

* cited by examiner

*Primary Examiner* — Laura Tso

(74) *Attorney, Agent, or Firm* — Richard C. Litman

(57) ABSTRACT

The Christmas light clip with magnets has an elongated base, a post extending upward from the base, and a support arm extending from the post parallel to the base in cantilever manner. The support arm terminates in a resilient, C-shaped clamp adapted for gripping a Christmas light bulb socket. At least one magnet is attached to the bottom surface of the base, and is adapted for attaching the base to a metallic structure, such as a roof, a gutter, a window frame, etc. A plurality of the Christmas light clips may be used to attach a string of lights to the metallic structure.

9 Claims, 4 Drawing Sheets

CHRISTMAS LIGHT CLIPS WITH MAGNETS

CROSS-REFERENCE TO RELATED APPLICATION

This application claims the benefit of U.S. Provisional Patent Application Ser. No. 61/006,522, filed Jan. 17, 2008.

BACKGROUND OF THE INVENTION

1. Field of the Invention

The present invention relates to illumination and holiday decorations. In particular, the present invention is a Christmas light clip with magnets.

2. Description of the Related Art

Many people typically use decorative lighting during festivals and holidays to show their spirit of an occasion. A popular type of decorative lighting is in a strip form and generally includes individual bulbs attached along an electrical conducting material, i.e. wire. It is common for people to attach these decorative lights outside their homes or business sometimes in shapes and designs reflective of a particular holiday, such as a tree during Christmas.

Typically, the light strips are attached to a structure using staples or nails that clamp the wire onto a wall or roof. This practice not only requires tools and is time consuming, but it also creates holes in the structure that can contribute to severe damage by causing leaks. Not all structures and surfaces are capable of supporting staples or slide-on plastic clips. Furthermore, high winds can cause a bulb to break either by agitation or by being forced by a gust into the attached rigid structure.

It would be desirable to attach Christmas lights in any desired place and at any desired angle, rather than being restricted to specific places and certain angles. It would be desirable to position Christmas lights pointing in any desired direction from any desired position on a roof or other support surface. There may also be less danger in securing Christmas lights midway down a gabled metal roof than along the edge. It would also be desirable to be able to attach Christmas lights to a support surface without having to search for a particular fastener that points the light in the desired direction at a given location, and without having to rearrange a string of lights to match socket fasteners to mounting locations on the support surface. Thus, a Christmas light clip with magnets solving the aforementioned problems is desired.

SUMMARY OF THE INVENTION

The Christmas light clip with magnets has an elongated base, a post extending upward from the base, and a support arm extending from the post parallel to the base in cantilever manner. The support arm terminates in a resilient, C-shaped clamp adapted for gripping a Christmas light bulb socket. At least one magnet is attached to the bottom surface of the base, and is adapted for attaching the base to a metallic structure, such as a roof, a gutter, a window frame, etc. A plurality of the Christmas light clips with magnets may be used to attach a string of lights to a metallic structure.

In use, a plurality of Christmas light clips with magnets is releasably mounted to a metallic structure in a design/pattern, such as a Christmas tree.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
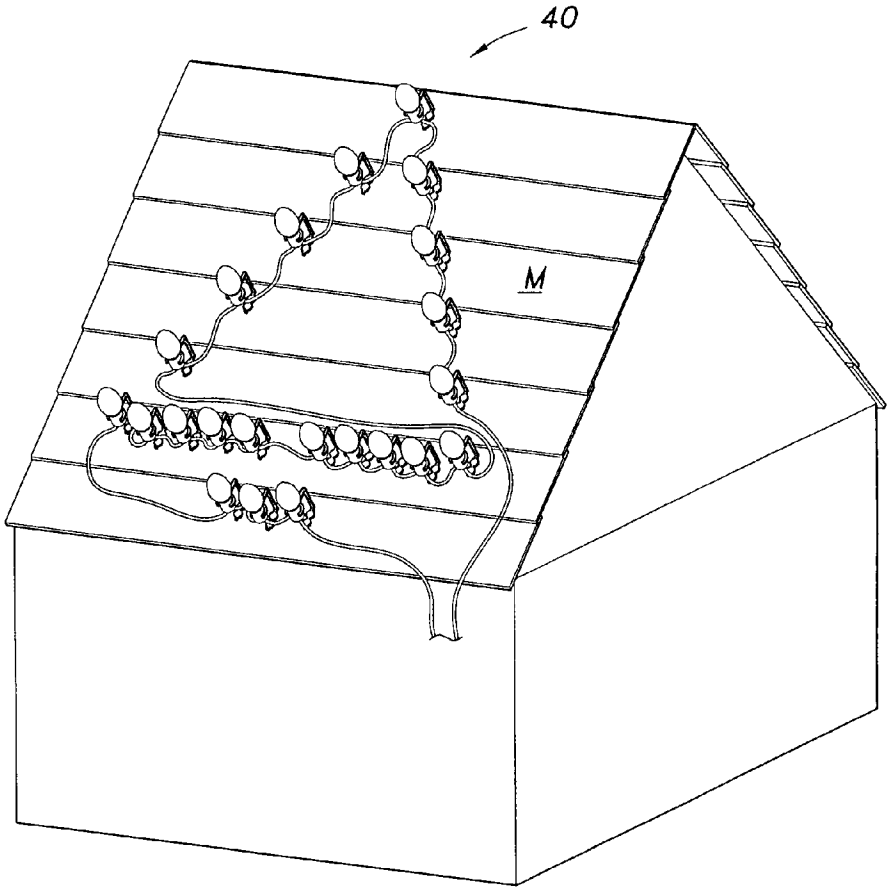
FIG. 1 is an environmental, perspective view of a Christmas light clip with magnets according to the present invention.

The present invention relates to a Christmas light clip with magnets, designated generally as 40 in the drawings. As shown in FIG. 1, the light clip 40 may be used in conjunction with a string of lights to decorate the metallic roof M of a building or other structure.

Figure 2:
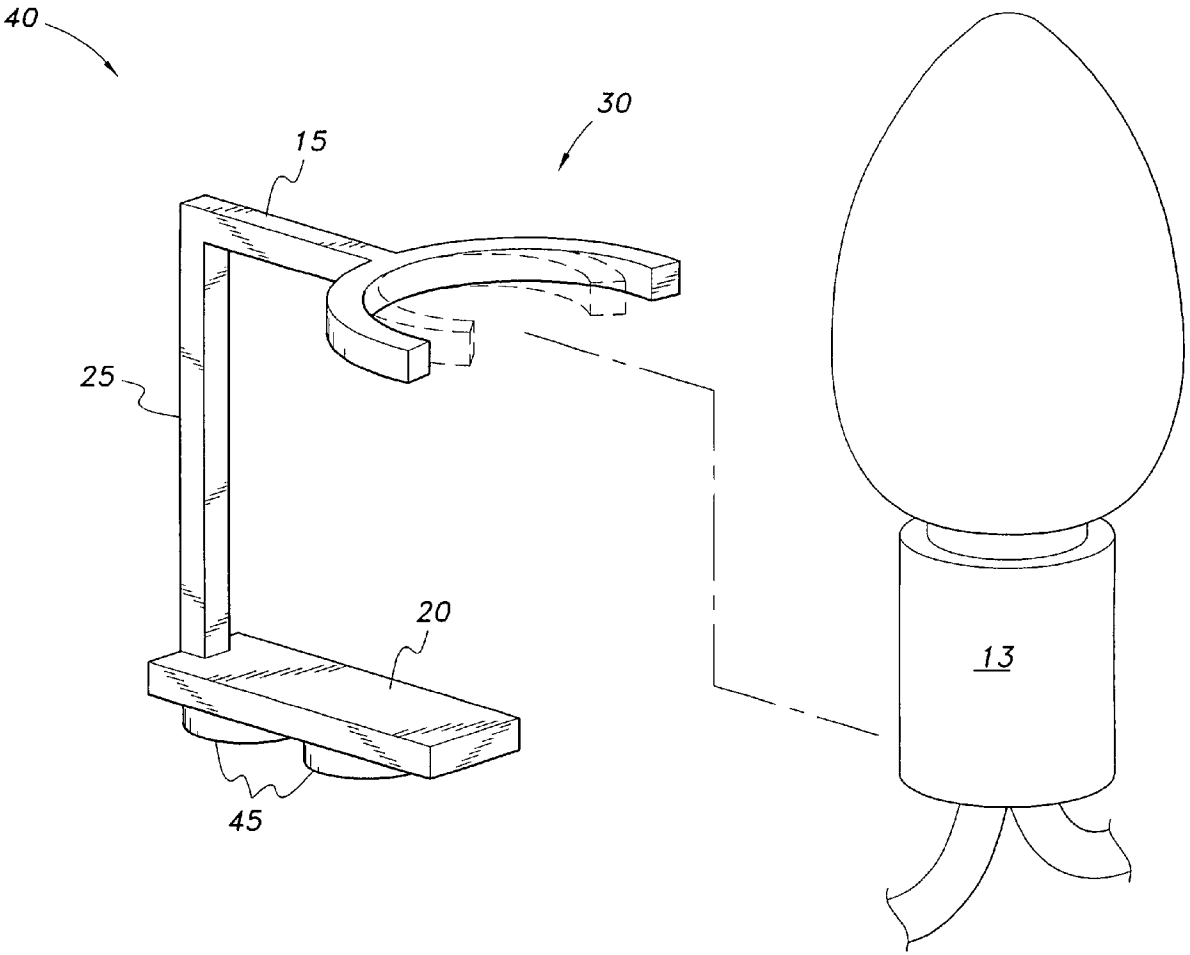
FIG. 2 is a perspective view of a Christmas light clip with magnets according to the present invention.
Figure 3:
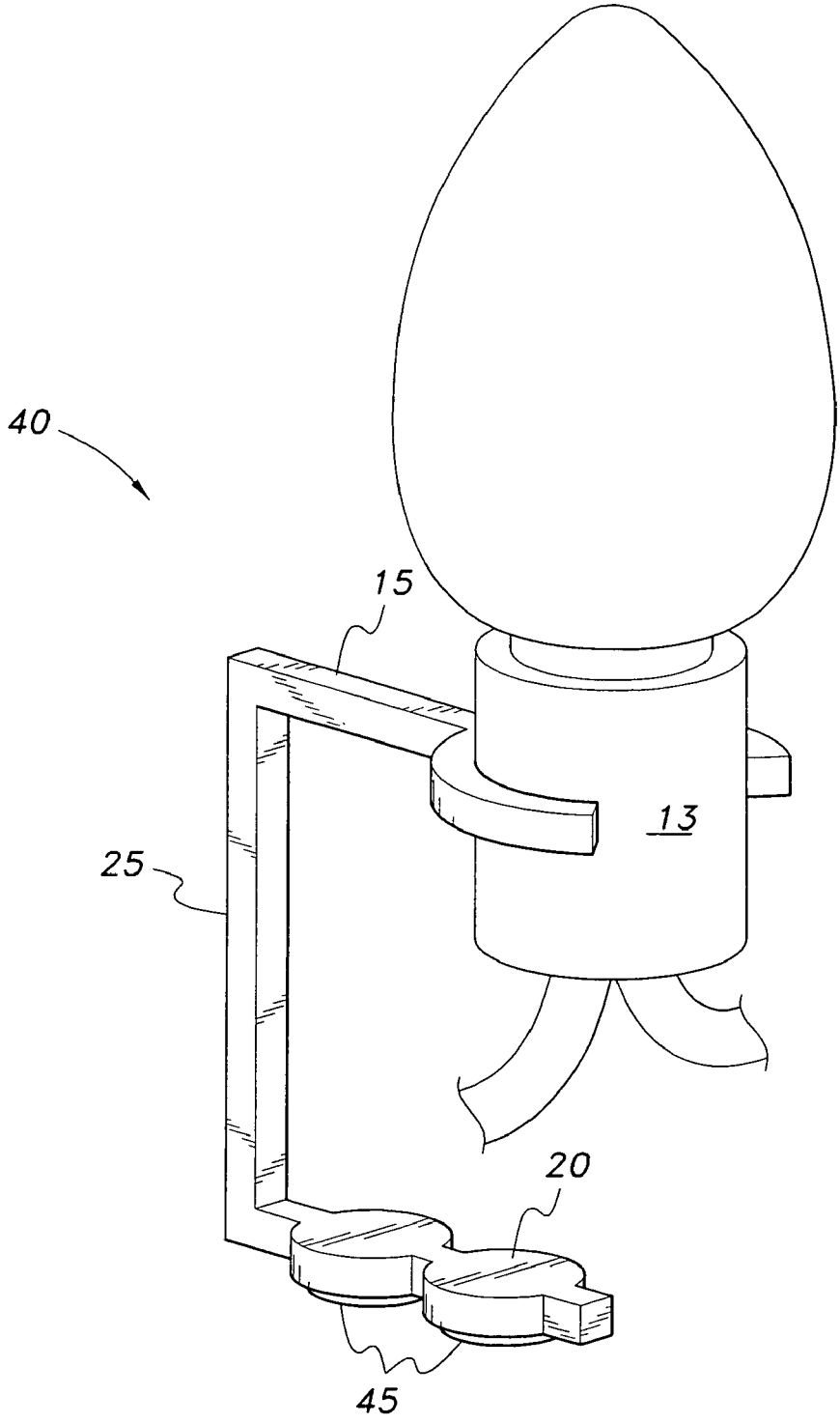
FIG. 3 is perspective view of the Christmas light clip with magnets according to the present invention.

As shown in FIGS. 2 and 3, the clip 40 has an elongated base 20 a post 25 extending upward from the base 20, and a support arm 15 extending from the post 25 parallel to the base 20. The support arm 15 terminates in a resilient, C-shaped yoke or clamp 30 adapted for resiliently gripping a Christmas light bulb socket 13. The base 20 has a bottom surface and one or more magnets 45 attached to the bottom surface of the base 20. The magnets 45 are adapted for attaching the clip 40 to a metallic or ferromagnetic support surface, such as a metal roof, a gutter, a window frame, a door frame, etc.

The clip 40 may be a single molded piece of material, or it may be three individual sides or parts attached at the ends. As shown in FIG. 2, the clip 40 is rigid plastic, yet has enough flexibility in order to allow it to bend when used outside and exposed to elements, such as high wind, and the furcations or jaws of the C-shaped clamp 30 are arcuate and resilient enough to retain the bulb socket 13. Other materials, such as aluminum, that can be used to make the clip 40 should have similar properties.

The clip 40 may also be used to hold a string of lights or the like.

Figure 4:
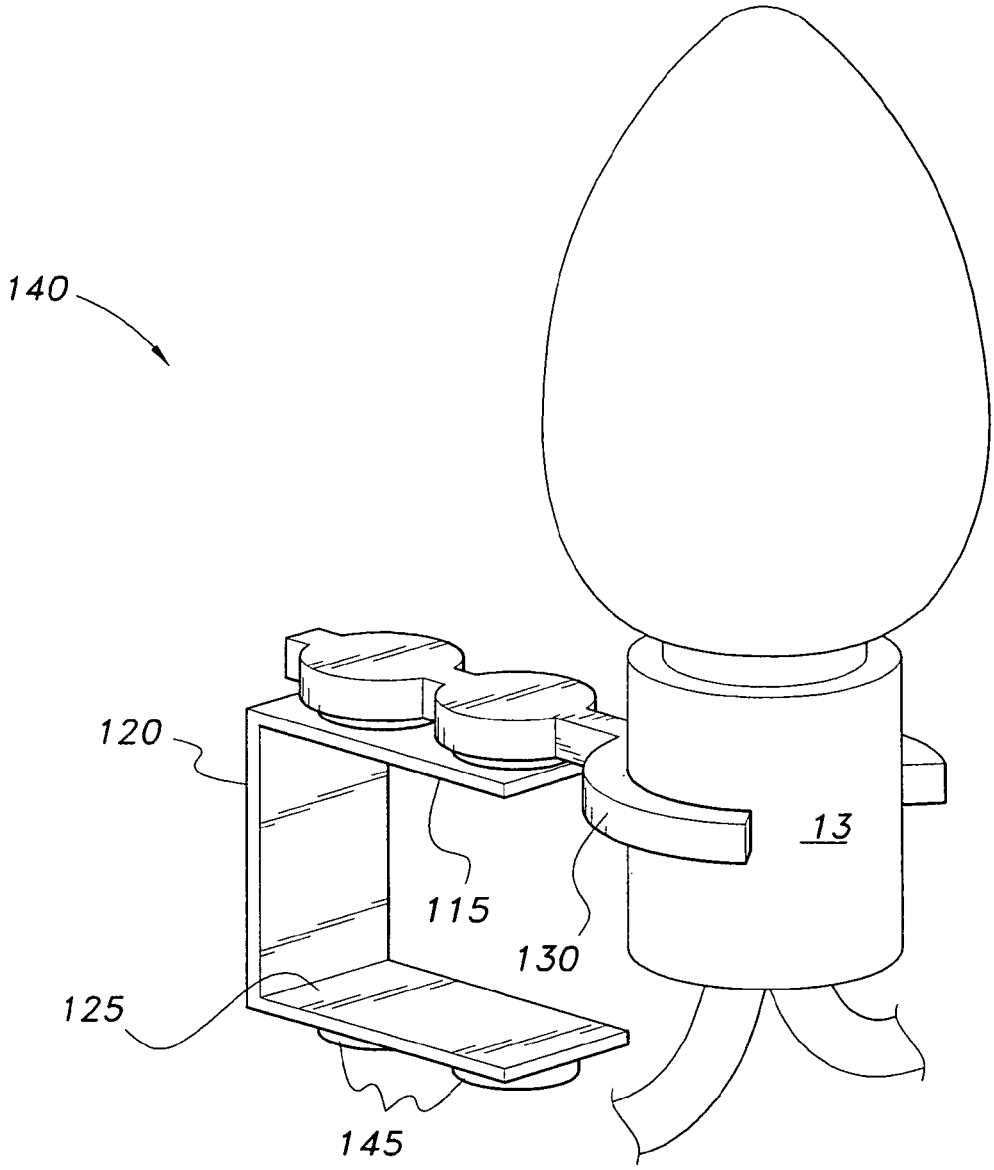
FIG. 4 is a perspective view of an alternative embodiment of a Christmas light clip with magnets according to the present invention.

FIG. 4 shows an embodiment of a Christmas light clip with magnets, designated generally as 140 in the drawing, which is similar to FIG. 2. However, in this embodiment, the post 120 and support arm 115 have the same width as the base 125. One or more magnets 145 are permanently attached to the bottom surface of the base 125. The C-shaped yoke or clamp 130 may be made in one piece with the support arm 115 by casting, molding, forging, or other manufacturing processes, or may be a discrete component attached thereto in any suitable manner, e.g., adhesives, welding, etc. The base 125, post 120, and support arm 115 may be formed from a single strip of malleable thin metal bent into a U-shape, having sufficient flexibility at the joints to allow some bending under high winds or to position the socket 13 to achieve the desired decorative effect, but also sufficient rigidity and resilience to maintain the support arm 115 and socket 13 in a position supported above the base 125 and the metallic or ferromagnetic support surface.

It is to be understood that the present invention is not limited to the embodiment described above, but encompasses any and all embodiments within the scope of the following claims.

I claim:

1. A Christmas light clip with magnets, comprising:

a base having a bottom surface;

a post extending from the base;

an elongated support arm extending from the post parallel to the base in cantilever manner, the support arm having an end forming a resilient, C-shaped clamp adapted for resiliently gripping a Christmas light socket; and at least one magnet attached to the bottom surface of the base, the magnet being adapted for attaching the base to a ferromagnetic structure;

wherein said base, said post, and said support arm are formed in a single piece.

2. The Christmas light clip with magnets of claim 1, wherein the clip comprises a single piece of molded plastic capable of resiliently flexing during use in high winds.

3. The Christmas light clip according to claim 1, wherein said at least one magnet comprises a plurality of magnets.

4. A Christmas light clip with magnets, comprising:

a rectangular base having a top surface and bottom surface;

a rectangular post having a top end and a bottom end, the bottom end being securely attached to the top surface of the base, the top end extending away from and perpendicular to the top surface of the base;

an elongated rectangular support arm securely attached at one end to the top end of the rectangular shaped post, the support arm extending perpendicular to the post and parallel to the base in a cantilever manner;

a resilient, C-shaped clamp adapted for resiliently gripping a Christmas light socket, the clamp having arcuate jaws; and at least one magnet attached to the bottom surface of the base, the magnet being adapted for attaching the base to a ferromagnetic structure;

wherein said base, said post, and said support arm are formed in a single piece.

5. The Christmas light clip of claim 4, wherein the clip comprises a single piece of molded plastic capable of resiliently flexing during use in high winds.

6. The Christmas light clip of claim 4, further comprising at least one magnet attached to the bottom surface of the base, the at least one magnet being adapted for magnetically attaching the base to a ferromagnetic structure.

7. The Christmas light clip according to claim 4, wherein said base, said post, and said support arm are formed from a single strip of malleable metal bent to form a U-shape.

8. The Christmas light clip according to claim 4, wherein said at least one magnet comprises a plurality of magnets.

9. The Christmas light clip according to claim 4, wherein said base, said post, and said support arm are uniform in width.

* * * * *